US006745728B2

(12) United States Patent
Batzill

(10) Patent No.: US 6,745,728 B2
(45) Date of Patent: Jun. 8, 2004

(54) COOLANT CIRCUIT AND METHOD FOR A MULTI-CYLINDER INTERNAL-COMBUSTION ENGINE

(75) Inventor: Manfred Batzill, Neuhausen (DE)

(73) Assignee: Dr. Ing. h.c.F. Porsche AG, Stuttgart (DE)

( * ) Notice: Subject to any disclaimer, the term of this patent is extended or adjusted under 35 U.S.C. 154(b) by 48 days.

(21) Appl. No.: 10/129,664

(22) PCT Filed: Mar. 29, 2001

(86) PCT No.: PCT/EP01/03607

§ 371 (c)(1),
(2), (4) Date: May 9, 2002

(87) PCT Pub. No.: WO01/83958

PCT Pub. Date: Nov. 8, 2001

(65) Prior Publication Data

US 2002/0162520 A1 Nov. 7, 2002

(30) Foreign Application Priority Data

May 3, 2000 (DE) ..... 100 21 525

(51) Int. Cl.[7] ..... F01P 3/00

(52) U.S. Cl. ..... 123/41.49; 123/41.82 R; 123/41.72; 123/41.57

(58) Field of Search ..... 123/41.49, 41.74, 123/41.72, 41.29, 41.82 R, 41.57

(56) References Cited

U.S. PATENT DOCUMENTS 3,889,644 A 6/1975 Moore
5,497,734 A * 3/1996 Okada ..... 123/41.1
5,915,346 A 6/1999 Rehr

FOREIGN PATENT DOCUMENTS

| | | |
|---|---|---|
| AT | 002106 | 4/1998 |
| DE | 19628762 | 1/1998 |
| DE | 19803808 | 8/1999 |
| GB | 542 009 | 12/1941 |
| GB | 646 201 | 11/1950 |
| JP | 60019912 | 2/1985 |
| JP | 03225015 | 4/1991 |
| JP | 05086970 | 6/1993 |
| JP | 06212970 | 8/1994 |

* cited by examiner

*Primary Examiner*—Henry C. Yuen
*Assistant Examiner*—Katrina B. Harris
(74) *Attorney, Agent, or Firm*—Crowell & Moring LLP

(57) ABSTRACT

A coolant circuit and method of operating a coolant circuit is provided for a multi-cylinder internal-combustion engine. A cooling jacket which surrounds a cylinder head housing and a cylinder block and is supplied with cooling liquid by way of a pump. The cylinder cooling jacket and the cylinder head cooling space are provided with a connection for feeding the cooling liquid and with the cooling liquid flowing parallel through the cylinder head housing and the cylinder block. Thus, a cooling of the cylinder block and the cylinder head which meets the requirements takes place without any additional control devices. The engine rapidly reaches its operating temperature, thereby reducing the cold running phase. As a result, the fuel consumption and the crude emissions can be reduced.

13 Claims, 4 Drawing Sheets

COOLANT CIRCUIT AND METHOD FOR A MULTI-CYLINDER INTERNAL-COMBUSTION ENGINE

The invention relates to a coolant circuit as well as to a method of operating a coolant circuit for a multi-cylinder internal-combustion engine having a cooling jacket surrounding a cylinder head housing and a cylinder block and supplied with cooling liquid by means of a pump.

A coolant circuit system of this type is known, for example, from European Patent Document EP 0 816 651 A1. A coolant circuit for an internal-combustion engine is described therein, in which the entire coolant flow is first guided through the cylinder head housing before it then flows through the cylinder block. So that the catalyst arranged in the exhaust system reaches its operating temperature as fast as possible after a cold start, the control of the coolant circuit is designed such that, below a coolant temperature T1, coolant flows only through the cylinder head housing and when T1 is reached, coolant also flows through the cylinder block.

In contrast, it is the object of the invention to implement by means of simple devices a coolant flow distribution which relates to the different temperature conditions in the cylinder block and the cylinder head of the internal-combustion engine and which meets the requirements.

According to the invention, this object is achieved by providing a coolant circuit for a multi-cylinder internal-combustion engine having a cooling jacket surrounding a cylinder head housing and a cylinder block and supplied with cooling liquid by means of a pump, characterized in that at least one cylinder cooling jacket and at least one cylinder head cooling space is provided with a connection for supplying the cooling liquid, and in that the flow of cooling fluid through the cylinder head housing and the cylinder block takes place in parallel. This objective is achieved by providing a method of operating a coolant circuit for a multi-cylinder internal-combustion engine, having a cooling jacket which surrounds a cylinder head housing and a cylinder block and which is supplied with cooling liquid by way of a pump, characterized in that the cooling liquid flows through the cylinder head housing and the cylinder block in parallel, that is simultaneously.

Additional advantageous further developments and improvements of the coolant circuit according to the invention are contained in the subclaims.

The coolant flow distribution, which meets the requirements, is coordinated by means of the cross-sections of the connections and/or by means of the flow resistances in the cooling jackets or cooling spaces such that approximately 70 to 80% of the coolant flow circulated for cooling the engine flows through the high-temperature-stressed cylinder head housing, while 20 to 30% is available for cooling the cylinder block.

The coolant advantageously flows transversely through the cylinder head housing. As a result, all cylinder head units are cooled optimally and uniformly. Distortions or component tensions in the cylinder head caused by temperature differences are reduced; a higher knock limit can be reached; whereby, in turn, the internal-combustion engine may have a higher compression.

Because of the fact that the coolant can flow transversely through the cylinder head housing, the connection for the cylinder head cooling space is connected with a longitudinal coolant duct which distributes the coolant uniformly to the individual cylinder head units by way of inlet openings provided at the longitudinal coolant duct.

The coolant circuit system according to the invention can be implemented in a simple and space-saving manner in that, on one side of a cylinder bank, one connection for the cylinder cooling jacket and one connection for a cylinder head cooling space are provided, while, on the other side, the cooling ducts of the cylinder cooling jacket and of the cylinder head cooling space lead by way of a common outlet into a return flow chamber.

It was found that, for cooling the cylinder blocks, it is sufficient that the cooling jacket for the cylinder block is constructed only in the upper area of the cylinder sides. The measure, which contributes to a further weight reduction, increases the efficiency of the internal-combustion engine and nevertheless ensures the required cooling of the temperature-stressed components of the internal-combustion engine.

An embodiment of the invention will be explained in detail in the following description and drawing.

DETAILED DESCRIPTION OF THE DRAWINGS

Figure 1:
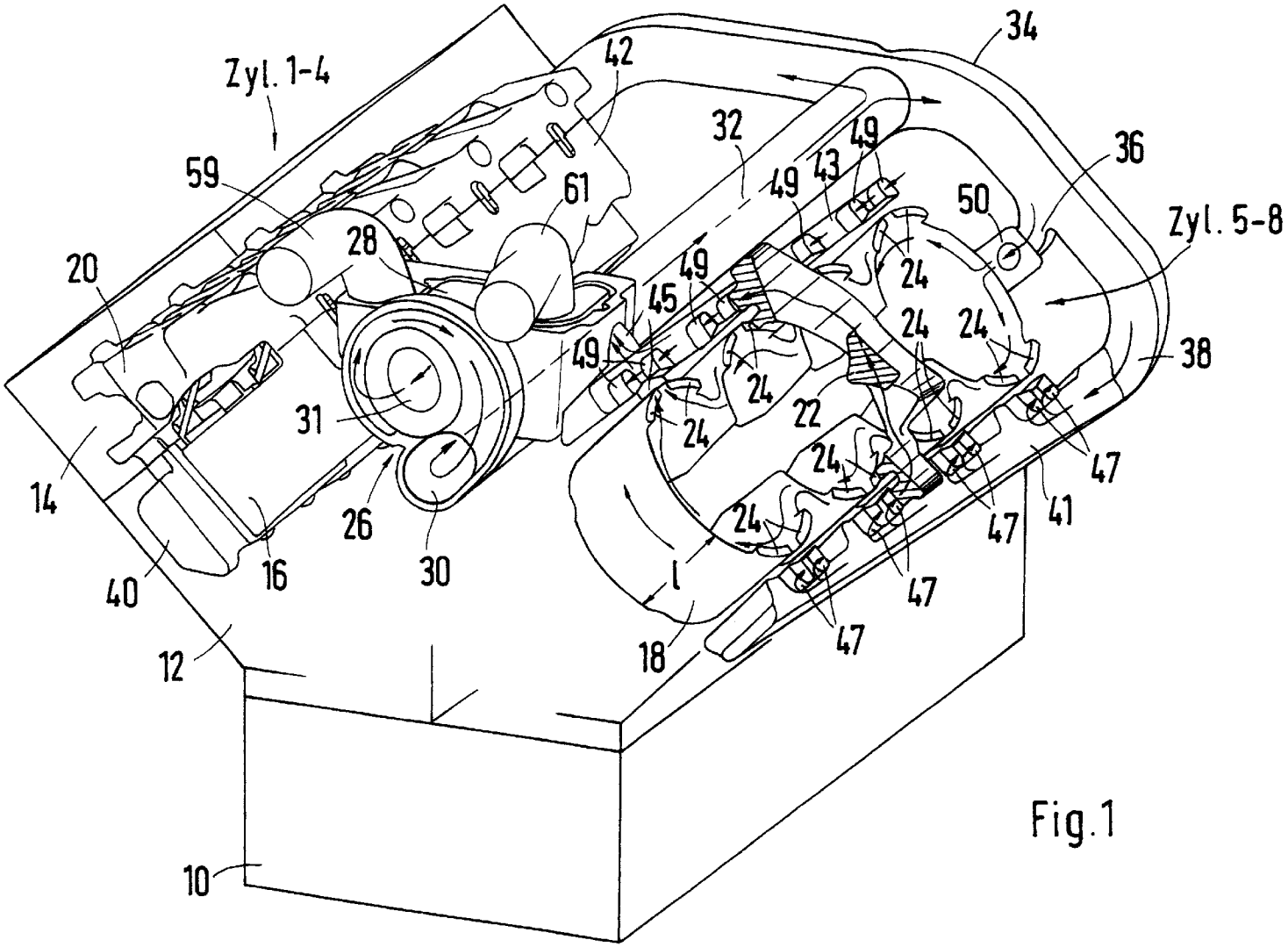
FIG. 1 is a schematic overall view of an internal-combustion engine.
Figure 2:
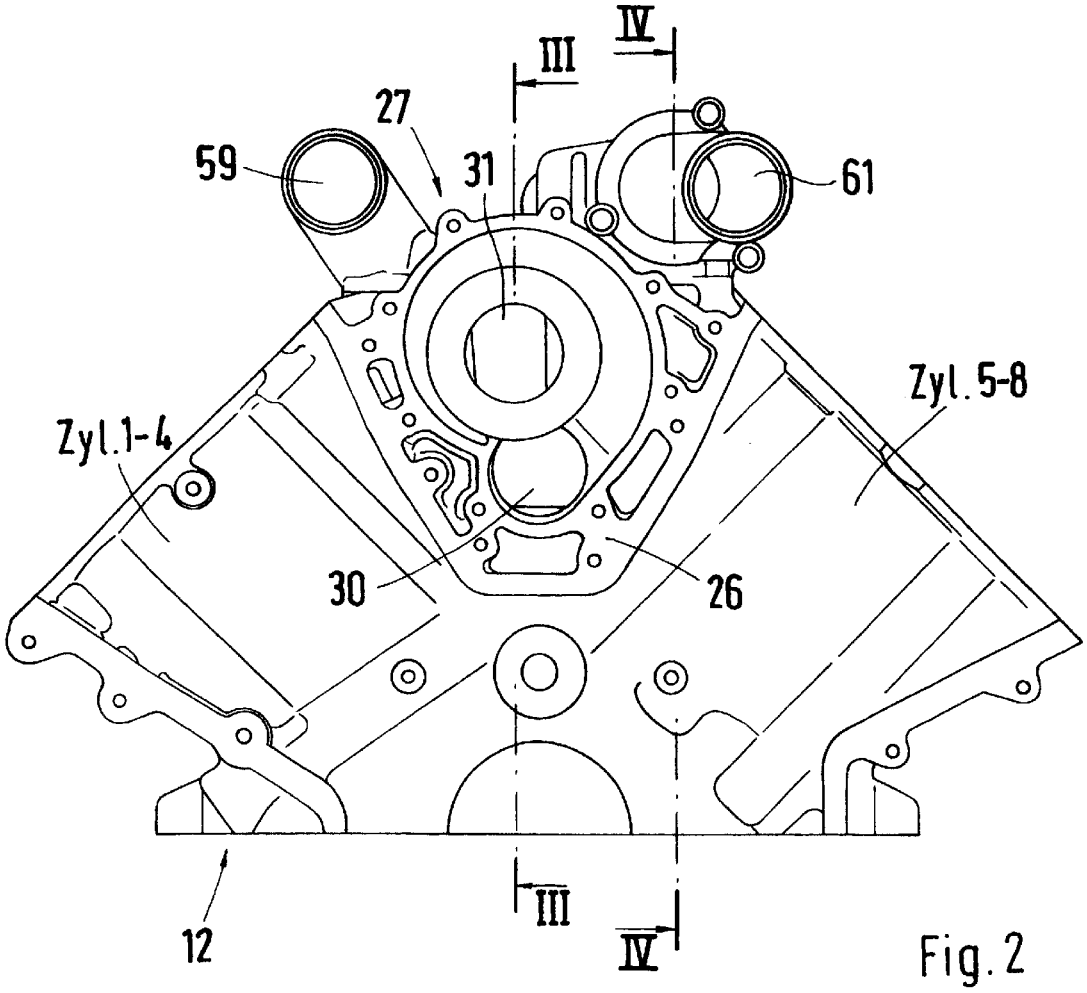
FIG. 2 is a frontal view of the internal-combustion engine constructed as a V-engine.
Figure 3:
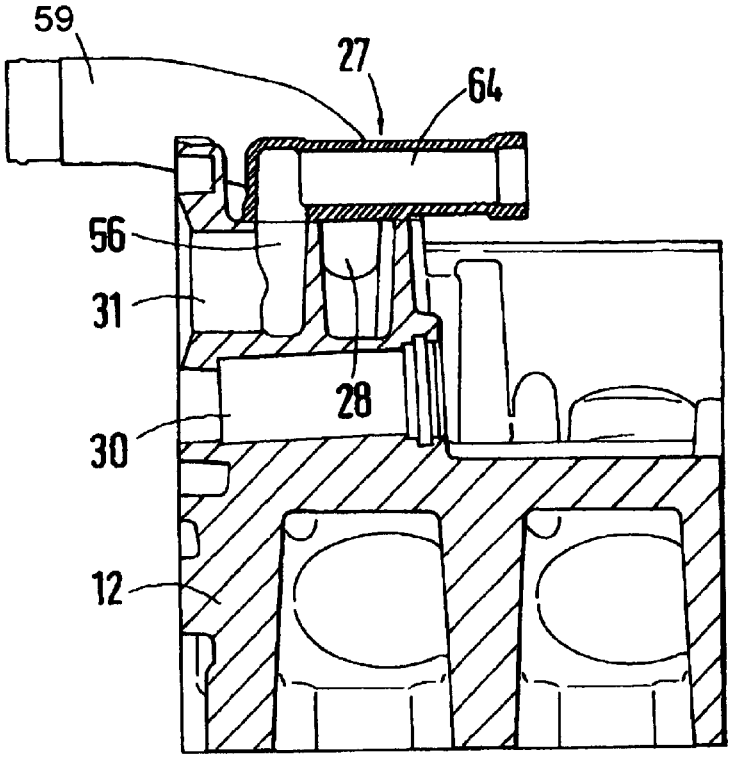
FIG. 3 is a sectional view along Line III—III in FIG. 2.
Figure 4:
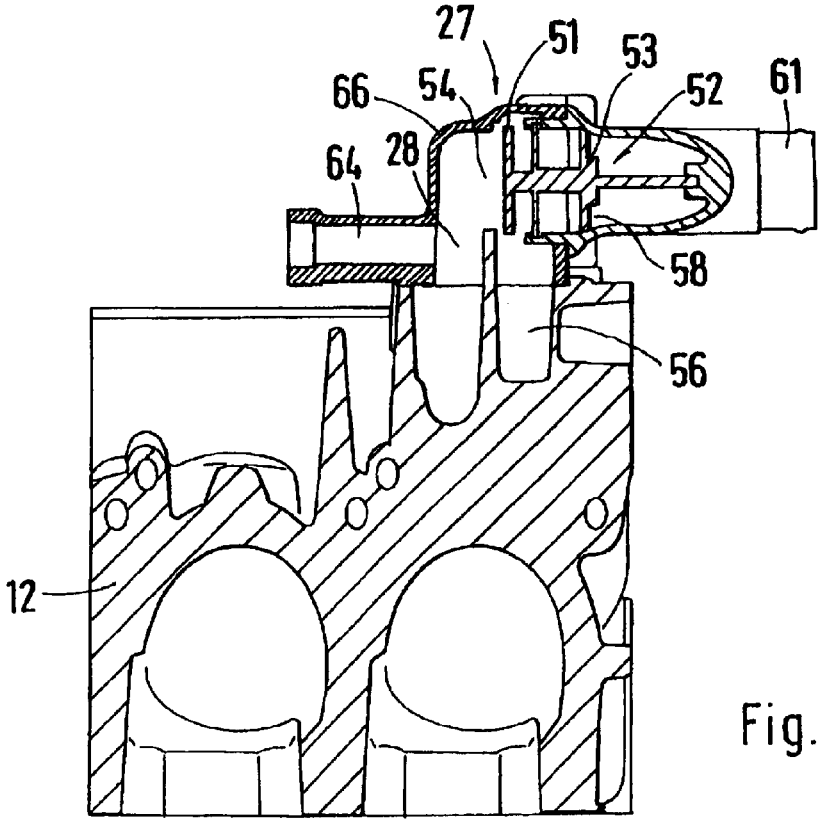
FIG. 4 is a sectional view along Line IV—IV in FIG. 2.

The V8-engine illustrated in FIG. 1 comprises a crankcase bottom half 10 and a crankcase top half 12, in which two cylinder banks 1 to 4 and 5 to 8 are arranged in a V-shape with respect to one another. For each cylinder bank, the crankcase top half 12 is adjoined by a cylinder head housing 14. The construction of the two cylinder banks is identical, FIG. 1 showing only the cylinder head housing 14 for cylinder bank 1 to 4 (on the left in the drawing), while the cylinder head housing is not shown for the right cylinder bank (cylinders 5 to 8) in order to better show the coolant flows. Both cylinder banks have cylinder cooling jackets 16 to 18 surrounding the cylinder sides, the cylinder cooling jackets 16, 18 being assigned only to the upper area of the cylinders sides. The length 1 of the cylinder cooling jackets 16, 18 amounts to approximately ½ of the total length of the individual cylinders or cylinder sides. The slot-type openings 24 arranged on the sides of the cylinder cooling jackets 16, 18 are closed by means of a cylinder head gasket which is not shown.

Cooling spaces 20, 22 are arranged in the cylinder head housing 14. For a better illustration of the cylinder head cooling spaces 20, 22, the cooling space cross-section 22 was shown for the right cylinder bank (cylinders 5 to 8).

The spirally constructed housing 26 of a water pump is arranged between the two cylinder banks, the lid part of the water pump, which is not shown, accommodating the turbine wheel for generating the coolant flow which is driven by way of the crankshaft. Behind the housing 26 of the water pump, a constructional unit 27 is provided which, among other things, has a return flow chamber 28 which, as will be described later in detail, forms the return flow for the coolant from the cylinder cooling jackets 16, 18 and the cylinder head cooling spaces 20, 22.

The delivery-side outlet 30 of the water pump housing 26 is connected with a coolant distributor pipe 34 by way of a coolant pipe 32 which extends between the two cylinder banks to the other side of the internal-combustion engine. For each cylinder bank, the coolant distributor pipe 34 has two connections respectively 36, 38 which in FIG. 1 are shown only for the right cylinder bank (cylinders 5 to 8). The first connection pieces 36 are connected with the cooling jackets 16, 18 through which the longitudinal flow takes place and which are arranged in the cylinder block, while the second connection pieces 38 are connected with outer longitudinal coolant ducts 40, 41 which are cast into the crankcase top half 12. The outer longitudinal coolant ducts 40, 41 have inlet openings 47 which are assigned to the individual cylinder head units and by way of which the coolant is guided into the cylinder head cooling spaces 20, 22. After transversely flowing through the cylinder head housing 14, the coolant arrives from the cylinder head cooling spaces 20, 22 in inner longitudinal coolant ducts 42, 43 which are also cast into the crankcase top half 12 and are provided with outlet openings 49. The outlet-side end of the inner longitudinal coolant ducts 42, 43 and the outlet-side end of the two cylinder cooling jackets 16, 18 lead by way of common outlets constructed as overflow bores 44, 45 into the return flow chamber 28.

Figure 5:
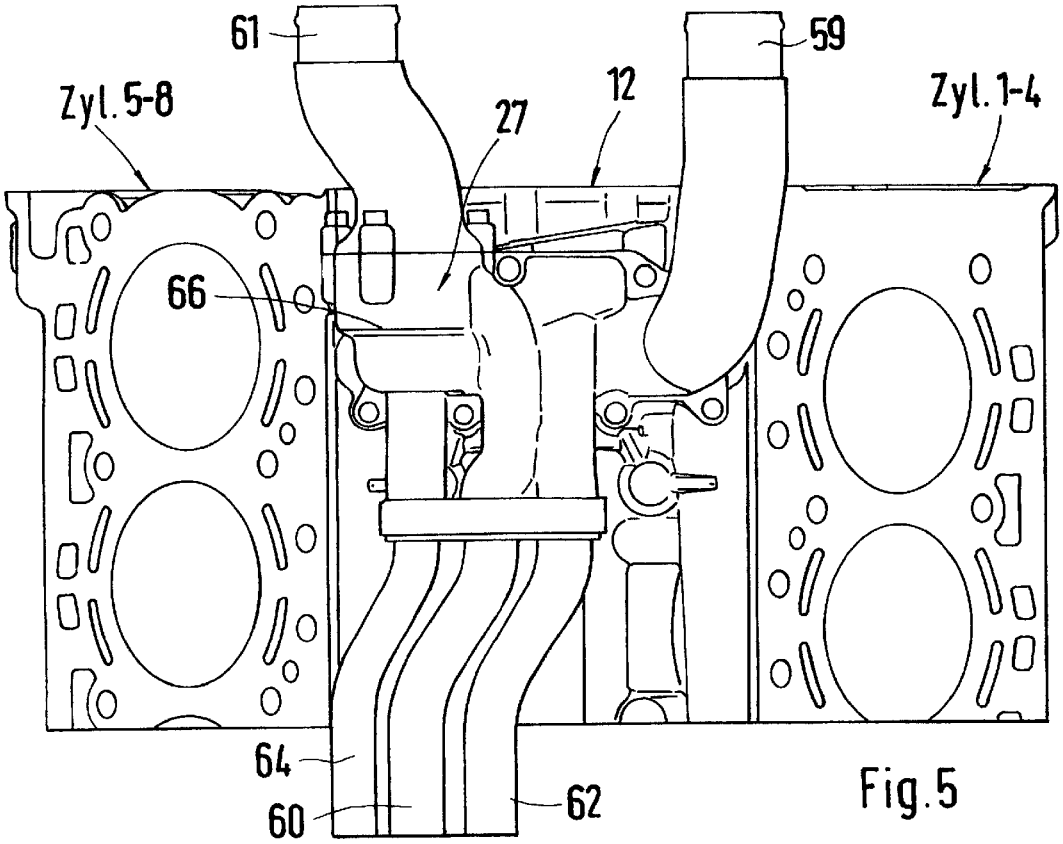
FIGS. 5, 6 are two tops views of a partial cutout of the internal-combustion engine.
Figure 6:
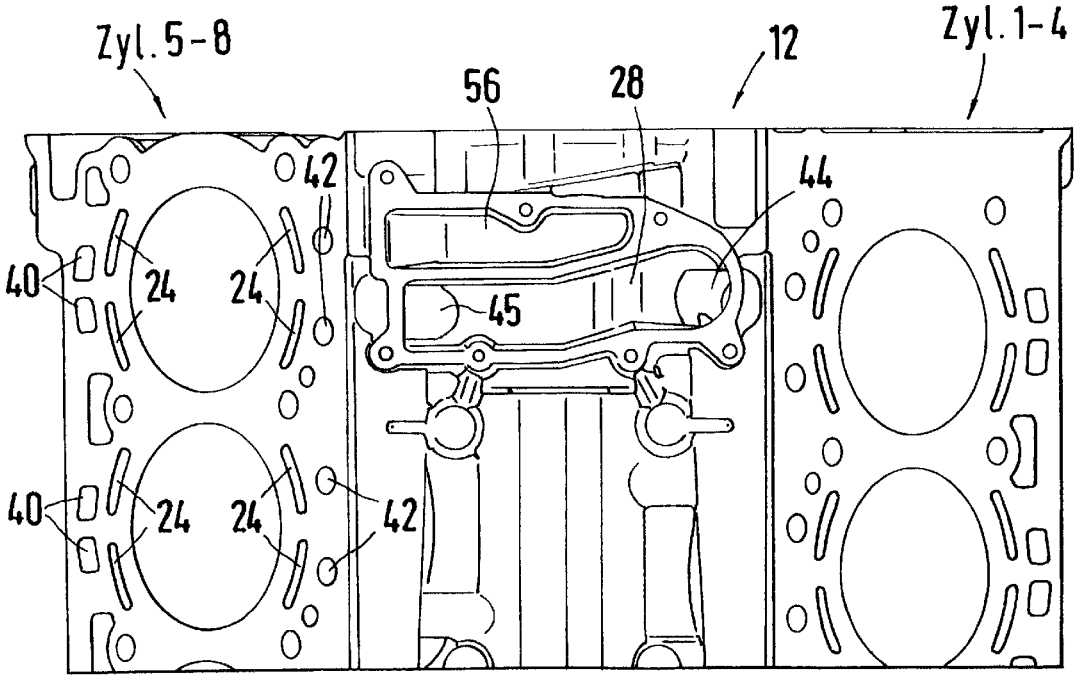

As illustrated in detail in FIGS. 2 to 6, the constructional unit 27 has, in addition to the return flow chamber 28, a second return flow chamber 56 which, by way of an opening 54 controlled by a first valve disk 51 of a thermostat 52, is connected with the first return flow chamber 56 and with the intake piece 31 of the pump housing 26. The constructional unit 27 including the two return flow chambers 28 and 56 and the thermostat 52 has a two-part construction, the lower part of the constructional unit 27, together with the pump housing 26, being cast into the crankcase top half 12 between the two cylinder banks. The housing lid 66 of the constructional unit 27 accommodating the thermostat 52 is screwed to the lower part of the constructional unit 27. The second valve disk 53 of the thermostat 52 controls a return flow opening 58 leading to the second return flow chamber 56, the stub 59 connected with the first return flow chamber 28 forming the forward flow and the stub 61 connected with the second return flow chamber 56 forming the return flow of a radiator circuit which is not shown in detail. As illustrated in FIG. 5, the second return flow chamber 56 is also connected with the return flow pipe 60 of heating circuit, which is not shown in detail, and a pipe 62 which leads to an expansion tank. Starting from the first return flow chamber 28, a pipe 64 forms the heating forward flow.

The coolant circuit activated in the warm-up phase of the engine, which in the following will be called a small coolant circuit, operates as follows:

In this operating phase, the opening 54 between the first return flow chamber 28 and the second return flow chamber 56 is opened up by the first valve disk 51 of the thermostat 52 (see FIG. 4) so that the coolant flows from the first return flow chamber 28 into the second return flow chamber 56. From there, it is delivered by way of the intake piece 31 of the water pump housing 26 into the coolant pipe 32 and is guided by way of the coolant distributor pipe 34 to the cylinder cooling jackets 16, 18 arranged in the cylinder block as well as by way of the outer longitudinal coolant ducts 40, 41 to the cylinder head cooling spaces 20, 22 arranged in the cylinder head housing 14. On the input side, a throttle 50 is provided in the cylinder cooling jackets 16, 18, by means of which throttle 50, the flow resistance is coordinated such that 70 to 80%, preferably 75%, of the coolant flow circulated for the cooling of the engine arrives in the cylinder head housing 14 by way of the outer longitudinal coolant ducts 40, 41. As a result of the indicated distribution percentage of the coolant flow, it is ensured that a cooling of the cylinder head housing 14 highly stressed by temperature and of the cylinder block takes place which meets the requirements. After the flowing of the coolant through the cylinder cooling jackets 16, 18 and the cylinder head cooling spaces 20, 22 of both cylinder banks, the coolant is returned by way of the common overflow bores 44, 45 into the first return flow chamber 28.

After the operating temperature of the internal-combustion engine has been reached, a switching-over can take place to a large coolant circuit, in addition to the above described small coolant circuit. As known, the large coolant circuit includes the radiator circuit. In this case, the opening 54 is closed by the first valve disk 51 of the thermostat 52, while the opening 58, which is controlled by the second valve disk 53, is opened up to the radiator circuit. The radiator circuit is thereby activated in which the coolant, after having passed through the small coolant circuit, arrives by way of the return flow connection piece 59, the radiator, which is not shown, and the return flow connection piece 61, in the second return flow chamber 56.

What is claimed is:

1. Coolant circuit for a multi-cylinder internal-combustion engine having a cooling jacket surrounding a cylinder head housing and a cylinder block and supplied with cooling liquid by means of a pump, characterized in that at least one cylinder cooling jacket and at least one cylinder head cooling space is provided with a connection for supplying the cooling liquid, in that the flow of cooling fluid through the cylinder head housing and the cylinder block takes place in parallel, and in that the cooling liquid flows transversely through the cylinder head cooling space by way of a longitudinal coolant duct connected with the connection, which longitudinal coolant duct has inlet openings assigned to individual cylinder head units and leading into the cylinder head cooling space.

2. Coolant circuit according to claim 1, characterized in that, on one side of a cylinder bank, the connection for the cylinder cooling jacket and the connection for the cylinder head cooling space are provided, while, on the other side, the cooling ducts of the cylinder cooling jacket and of the cylinder head cooling space lead by way of a common outlet into a return flow chamber.

3. Coolant circuit according to claim 2, characterized in that the return flow chamber is connected by way of an opening controllable by means of a thermostat with a chamber which has an opening for the connection of a radiator circuit, which opening can also be controlled by means of the thermostat.

4. Coolant circuit according to claim 3, characterized in that the return flow chamber is provided with a forward flow connection and the chamber is provided with a return flow connection for a heating circuit.

5. Coolant circuit according to claim 3, characterized in that the chamber has a return flow connection for a water circuit equipped with an expansion tank.

6. Coolant circuit according to claim 2, characterized in that the return flow chamber is provided with a forward flow connection and the chamber is provided with a return flow connection for a heating circuit.

7. Coolant circuit according to claim 3, characterized in that the chamber has a return flow connection for a water circuit equipped with an expansion tank.

8. Coolant circuit according to claim 2, characterized in that the chamber has a return flow connection for a water circuit equipped with an expansion tank.

9. Coolant circuit according to claim 1, characterized in that the cylinder cooling jacket arranged in the cylinder block extends only in the upper area of the cylinder sides.

10. Method of operating a coolant circuit for a multi-cylinder internal-combustion engine, having a cooling jacket which surrounds a cylinder head housing and a cylinder block and which is supplied with cooling liquid by way of a pump, at least one cylinder cooling jacket and at least one cylinder head cooling space being provided with a connection for supplying the cooling liquid, comprising providing simultaneous parallel cooling liquid flows through the cylinder head housing and the cylinder block, wherein the cooling liquid flows transversely through the cylinder head cooling space by way of a longitudinal coolant duct connected with the connection, which longitudinal coolant duct has inlet openings assigned to individual cylinder head units and leading into the cylinder head cooling space.

11. Method according to claim 10, characterized in that the cross-section of a the connection for a cylinder cooling jacket and the cross-section of the connection for a cylinder head cooling space and/or the flow resistances in the cylinder cooling jacket and in the cylinder head cooling space are coordinated such that 20 to 30% of the coolant flow circulated for cooling the engine flows through the cylinder cooling jacket and 70 to 80% flows through the cylinder head cooling space.

12. Method according to claim 11, characterized in that the cooling liquid flows through the cylinder block in the longitudinal direction.

13. Method according to claim 10, characterized in that the cooling liquid flows through the cylinder block in the longitudinal direction.

* * * * *